US006089580A

United States Patent [19]

Borel et al.

[11] Patent Number: 6,089,580

[45] Date of Patent: Jul. 18, 2000

[54] CHASSIS FOR IN-LINE ROLLER SKATES

[75] Inventors: Rene Borel, Saint-Sylvestre; Ivan Bosse, Annecy, both of France

[73] Assignee: Salomon S.A., Metz-Tessy, France

[21] Appl. No.: 09/035,815

[22] Filed: Mar. 6, 1998

[30] Foreign Application Priority Data

Mar. 7, 1997 [FR] France ..... 97 02964

[51] Int. Cl.[7] ..... A63L 17/00

[52] U.S. Cl. ..... 280/11.22; 280/11.27; 280/809

[58] Field of Search ..... 280/11.19, 11.22, 280/11.23, 11.27, 11.28, 809, 11.2

[56] References Cited

U.S. PATENT DOCUMENTS 5,560,625 10/1996 Kuykendall ..... 280/11.27
5,630,624 5/1997 Goodman ..... 280/809
5,806,860 9/1998 Conte ..... 280/809
5,836,591 11/1998 Roderick et al. ..... 280/11.27

FOREIGN PATENT DOCUMENTS 0677309 10/1995 European Pat. Off. .
0752260 1/1997 European Pat. Off. .
296 15 352 U 1/1997 Germany .

*Primary Examiner*—Richard M. Camby
*Attorney, Agent, or Firm*—Greenblum &Bernstein P.L.C.

[57] ABSTRACT

Chassis for roller skates, especially in-line roller skates, of the type constituted of two lateral flanges bearing the wheels and by an upper platform connecting the two flanges. The chassis includes at least one central portion constituted by a detachable wear plate on at least one of the lateral flanges, the detachable plate extending between two wheels, from the lower edge of the flange, and wherein the chassis comprises a scalloping at the level of each detachable part. The detachable wear plates allow various types of skating styles to be accommodated while limiting the wear and tear of the chassis.

17 Claims, 3 Drawing Sheets

CHASSIS FOR IN-LINE ROLLER SKATES

BACKGROUND OF THE INVENTION

1. Field of the Invention

The present invention is related to a chassis, specifically for in-line roller skates intended to be used "aggressively".

2. Description of Background and Relevant Information

For aggressive use, the skate and especially its chassis is subject to substantial stresses because the user executes a variety of figures and acrobatic movements, and especially glides over various obstacles such as metallic rails (stair guard rails, balustrades) or concrete walls.

These figures and movements are generally executed not with the wheels but with the chassis of the skate itself, especially in the area of the central part thereof, between the two central wheels.

As a result, the flanges of the chassis are subjected to substantial wear and tear, both in a vertical direction which corresponds to gliding over rails, as well as in a transverse direction, which corresponds to gliding over walls.

In order to limit such wear and tear, certain wear elements shaped like elongate plates and commonly known as "grind plates" are available, such plates being intended to be fixed on each of the lateral parts or flanges of the chassis, and capable of being replaced in case of deterioration.

These plates can also be made from a variety of different materials depending on the type of activity and the degree of gliding desired. Thus, a metallic plate provides good protection for the chassis against wear and tear but it has the disadvantage of being too slippery and not allowing good speed control for the skater.

This is the reason why such plates are generally made of a synthetic material, so as to provide better speed control, but in this case, protection against the wear and tear of the chassis is very inadequate.

In addition, a certain amount of wear in the vertical direction of these plates and the chassis is generally desired so as to have, at the level of the support surface of the chassis during gliding, a complementary shape, known as a "groove" that is generally used for the glide surface, such as a rail. However, in this case, it is not possible to change the shape of the "groove" except by wearing the chassis out even more, and this is a disadvantage in case the user's skating style changes or evolves.

As such, although a certain amount of chassis wear is desirable, too much deterioration thereof means that it must be replaced, resulting in substantial expenses.

Finally, the attached wear plates have the disadvantage of constituting an over-thickness with respect to the chassis, and this can have a hampering factor during use.

SUMMARY OF THE INVENTION

An object of the invention is to overcome the aforementioned disadvantages and to provide an improved chassis that allows it to be used satisfactorily for various styles while limiting wear and tear.

This object is achieved by means of the chassis of the invention, which is of the type constituted by two lateral flanges bearing the wheels and by an upper platform connecting the two flanges, by the fact that the chassis includes at least one central portion constituted of a detachable wear plate on at least one of the lateral flanges, that the detachable part extends between two wheels from the lower edge of the flange, and that the chassis includes a scalloping at the level of each detachable part.

As a matter of fact, the provision of a scalloping for the chassis at the level of the central detachable part of the chassis allows one to guarantee the absence of wear and tear for the chassis.

Furthermore, this central part can be changed extremely easily and quickly in case of wear or if the style changes.

BRIEF DESCRIPTION OF THE DRAWINGS

The invention will be better understood and other characteristics thereof will become more apparent from the description that follows with reference to the annexed schematic drawings which represent, via non-restrictive examples, several embodiments wherein.

DETAILED DESCRIPTION OF THE INVENTION

Figure 1:
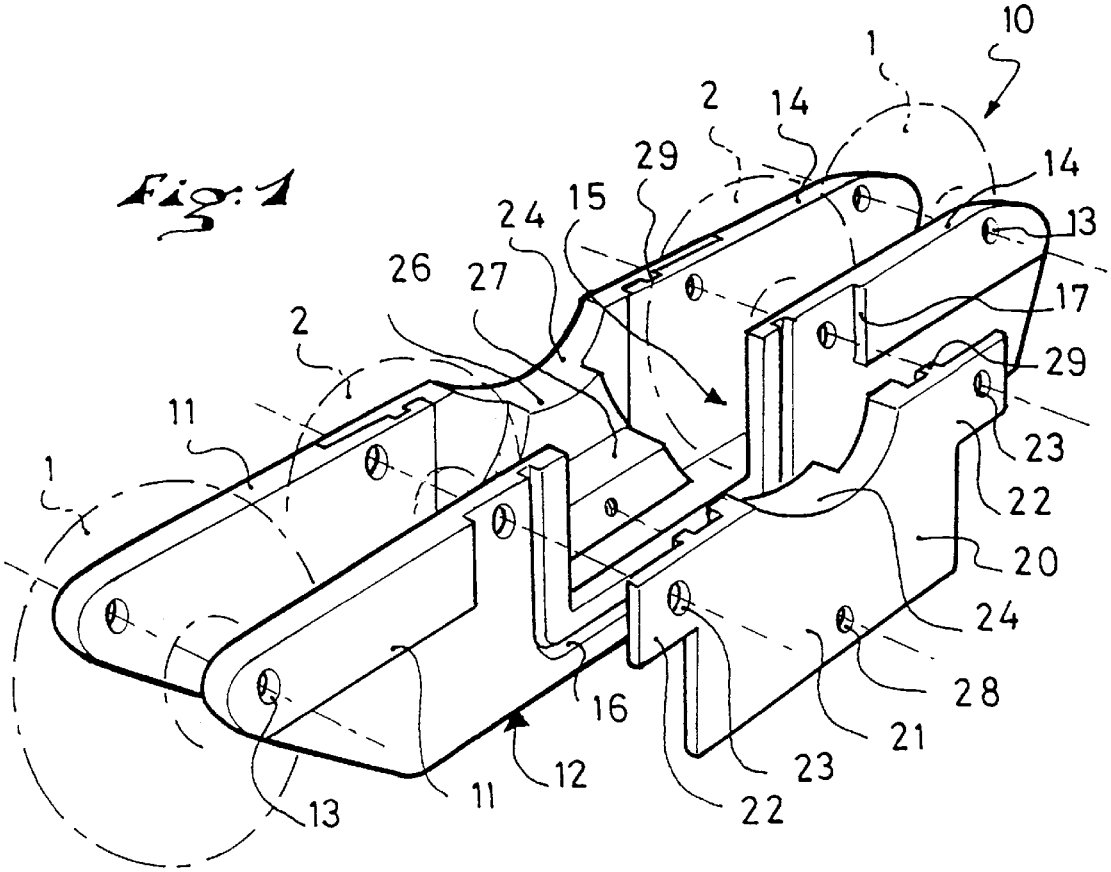
FIG. 1 is a bottom, exploded perspective view of a chassis according to a first embodiment.

As can be seen from FIG. 1, the chassis 10 according to the invention is constituted by two parallel, lateral flanges 11, connected at their upper ends by a platform 12 intended to receive a boot, and equipped at their lower ends with holes 13 for the assembly of the wheel axles, respectively the outer wheels 1 and central wheels 2.

In addition, the chassis 10 is equipped, in the area of the central portion of each lateral flange 11, with a downwardly open wide cut-out or scalloping 15 extending in height from the lower edge 14 of the flange up to the level of the upper platform 12.

Each scalloping 15, which has a substantially rectangular shape, extends substantially in the longitudinal direction, along the entire length between the axles of the central wheels 2.

In addition, each scalloping 15 is equipped along its edge with a peripheral groove 16 having a rectangular transverse section.

A wear plate 20 is associated to each scalloping 15, at least partially covering a scalloping, such plate being intended to be fixed on the corresponding flange 11, so as to constitute the central detachable part of the chassis.

Figure 3:
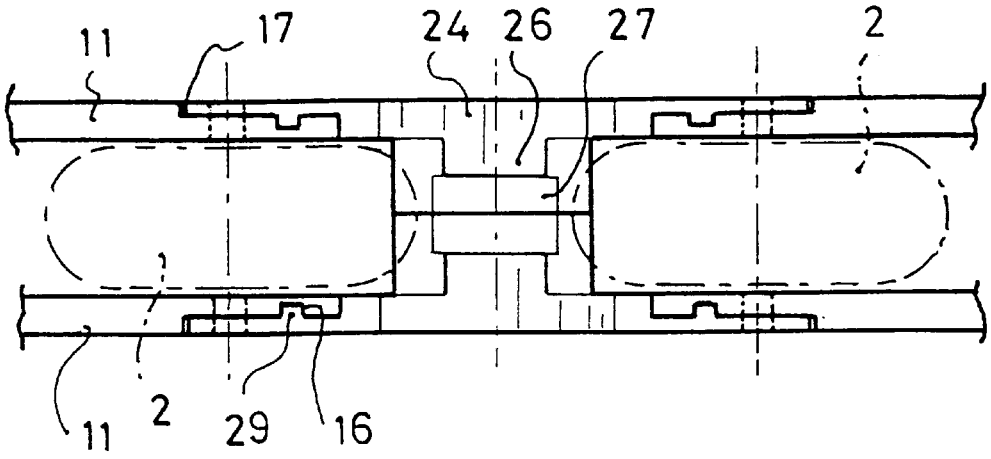
FIG. 3 is a bottom view of the chassis of FIG. 1.

As can be seen especially from FIGS. 1 and 3, each flange 11 of the chassis includes a recess 17 in its thickness around the scalloping 15, and its depth corresponds to the thickness of each wear plate 20 such that the wear plate does not project with respect to the outer surface of each flange at least at the level of the lower edge 14, but instead constitutes a smooth surface therewith.

Figure 2:
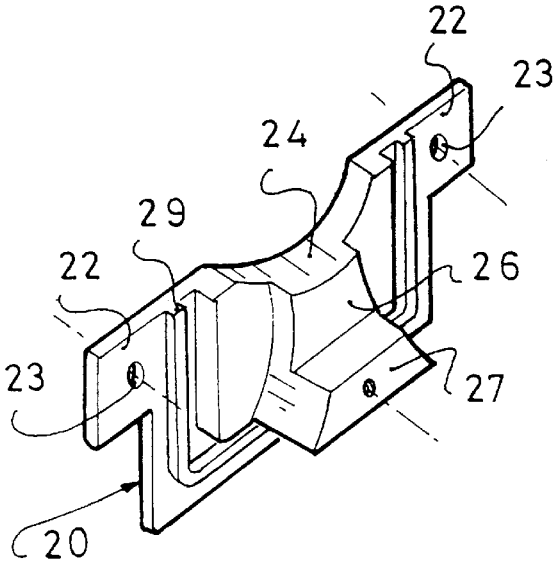
FIG. 2 is a perspective view of the central wear portion of the chassis of FIG. 1.

FIGS. 1 through 3 show the exact construction of each wear plate 20.

Externally, with reference to FIG. 1, each wear plate has a shape substantially like a T, or in other words, a substantially rectangular central portion 21 corresponding to the associated scalloping 15, and two lateral affixing tabs 22 extending on either side of the central portion 21 at the lower end thereof, and bearing holes 23 intended to affix the wear plate 20 on the associated flange by the intermediary of the axles of the central wheels 2.

The lower edge of the wear plate 20 is also equipped with a central groove 24, having a variable shape, in this case a semi-circular shape, and defines the "groove" that is used as the support surface, of a complementary shape, on rail type elements.

Depending on the type of use desired, the groove 24 can have a totally different shape, and can be triangular, trapezoidal, etc.

As has been shown more specifically in FIGS. 2 and 3, the wear plate 20 is equipped at the level of the groove 24 with an over-thickness 26, that projects with respect to the inner surface of the plate 20, and extends along the entire height thereof.

This over-thickness 26 is intended to increase the support surface of the chassis when the groove 24 is used for gliding maneuvers, such as have been shown more specifically in FIG. 3, the over-thicknesses 26 of the two wear plates 20 being less than the distance between the two flanges such that a gap is always left therebetween.

Inversely, each wear plate 20 is equipped at the upper end of its inner surface with a shoulder 27 projecting within the chassis by a value corresponding to half the distance between the two flanges.

Each shoulder 27 is equipped with a hole 28 intended to receive an affixing screw pressing the two shoulders 27 against one another.

These shoulders 27 are used as a mutual connection for the wear plates 20 and provide a corresponding stiffening to the chassis.

In addition, each wear plate is equipped along its inner surface with a peripheral rib 29 intended to cooperate with the peripheral groove 16 of the associated flange.

The association of the rib 29 with the groove 16 enables one to guarantee a good positioning for each wear plate on the attached flange, as well as a certain recovery of forces by the chassis.

As is easy to envision, the wear plates 20 can be subject to wear up to the level of the shoulders 27, and thus substantially up to the level of the upper platform, without causing any wear of the chassis, which thus remains intact. In addition, these wear plates can be changed very easily in case of wear and tear, or if it is desired to change the shape of the "groove" 24, and all this can be accomplished at minimal expense.

Furthermore, the central scalloping of the chassis has no adverse effect on the stiffness thereof because various reinforcement means, such as a shoulder 27 and ribs 29 are provided at the level of each wear plate for the recovery of forces.

Figure 4:
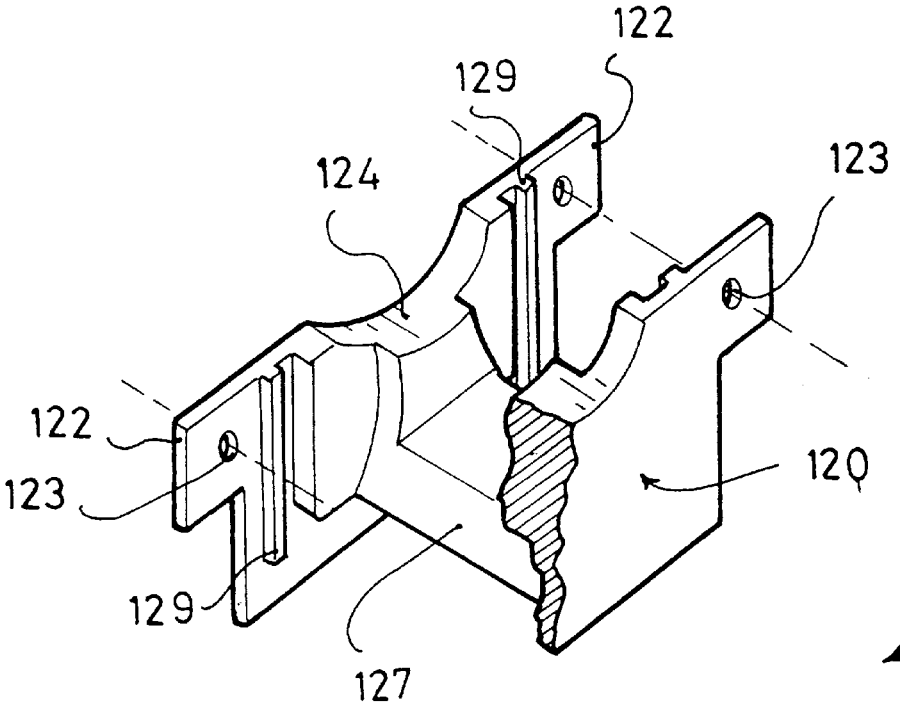
FIG. 4 is a view similar to FIG. 2 of a central wear portion according to another embodiment.

In the embodiment shown in FIG. 4, the two wear plates 20 are replaced by one wear plate 120 made all in one piece, equipped at its upper end with bridge 127, which is the equivalent of the shoulders 27 of the independent wear plates In addition, the wear plate 120 includes the same characteristics as the wear plates 20, and these characteristics have been designated by the same references increased by 100, and its operation is therefore identical.

Figure 5:
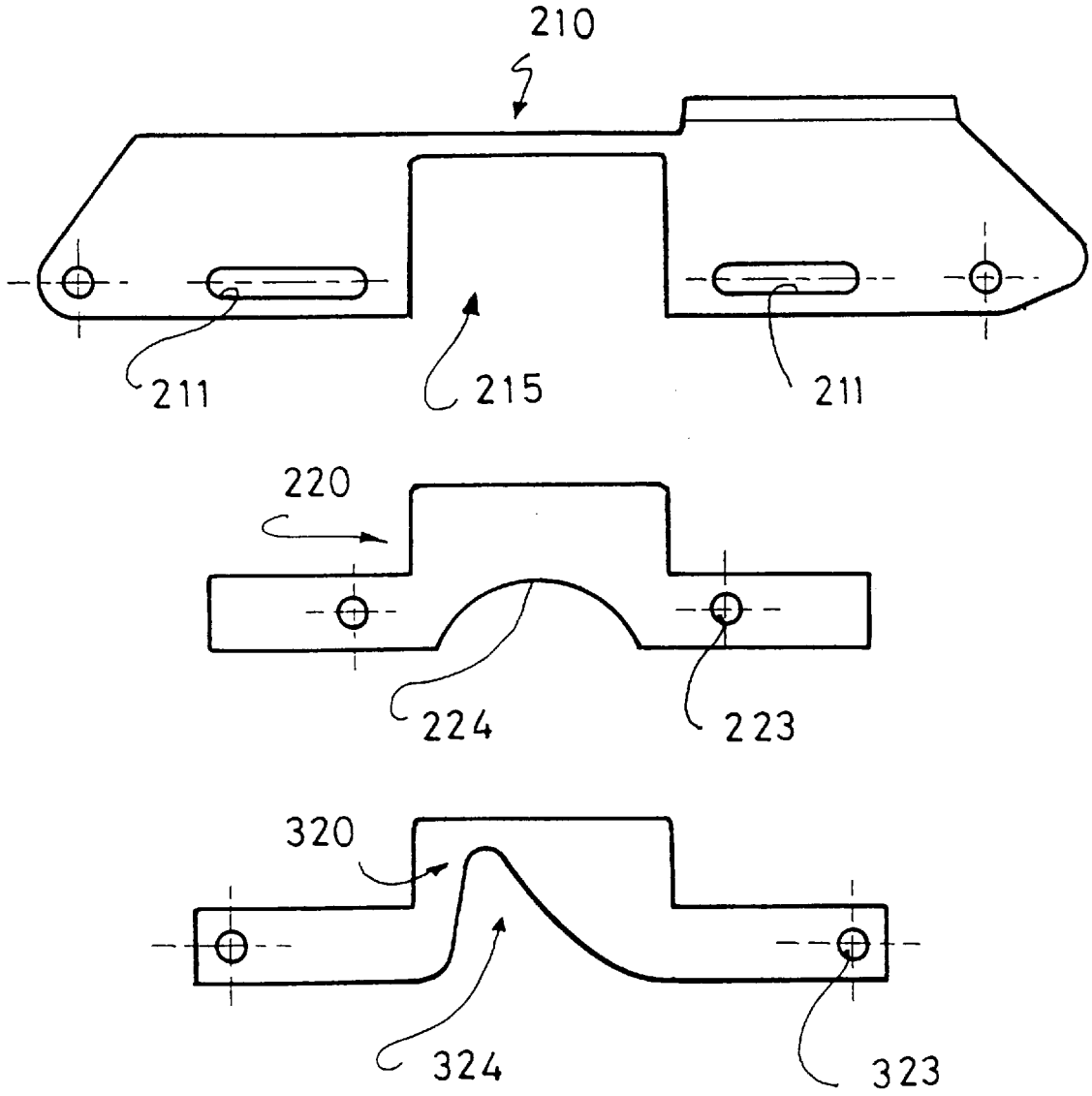
FIG. 5 is a side view of a chassis and the central wear elements associated thereto according to another embodiment.

FIG. 5 shows another embodiment of the wear plates 220, 320 according to the invention that are comparable to the plate 120, and connected, with different spacings, to the longitudinally central wheels, i.e., intermediate wheels. Since the characteristics of the wear plates 220, 320 are the same as the wear plates 20, these characteristics have been designated by the same references increased by 200 and 300 respectively, and their operation is therefore identical.

In this case, the chassis 210 has the same characteristics as the chassis 10, with the exception of the fact that oblong horizontal slots 211 are provided for the placement of the affixing holes of the central wheels. Since the characteristics of the chassis 210 are the same as the chassis 10, these characteristics have been designated by the same references increased by 200.

The wear plate 220 has a central groove 224 having a semi-circular shape and affixing holes 223 for the central wheels that are very close together.

The wear plate 320 has a central groove 314 having a substantially triangular shape and affixing holes 323 for the central wheels that are very far apart.

It is easy to understand that the use of wear plates 220 or 320 allows, depending on the specific case, the central wheels to be more or less space apart and to have a different contour as compared to the central groove.

Other combinations can be envisioned without however leaving the scope of the instant invention.

The instant application is based upon the French priority patent application No. 97.02964 filed on Mar. 7, 1997, the disclosure of which is hereby expressly incorporated by reference thereto, and the priority of which is hereby claimed under 35 USC 119.

What is claimed is:

1. A chassis for a roller skate, said chassis comprising:

two lateral flanges bearing a plurality of wheels and an upper platform connecting said two flanges, said chassis further having a central portion and an upward scalloping in said central portion;

a detachable wear plate on said central portion of said chassis, said wear plate being statically positioned on one of said lateral flanges and extending between two of said wheels from a lower edge of said one of said lateral flanges.

2. A chassis as defined by claim 1, wherein:

said scalloping extends in height substantially up to a level of said upper platform.

3. A chassis as defined by claim 1, wherein:

each said scalloping comprises a peripheral groove and each said wear plate comprises an associated peripheral rib.

4. A chassis as defined by claim 1, wherein:

said wear plate comprises a lower edge equipped with a central groove.

5. A chassis as defined by claim 4, wherein:

each said wear plate comprises, in an area of said groove, with an laterally extending over-thickness.

6. A chassis as defined by claim 1, further comprising:

a second detachable wear plate on said central portion of said chassis, said second wear plate being statically positioned on a second of said lateral flanges and extending between said two of said wheels from said lower edge of said second of said lateral flanges;

each of said wear plates comprises an upper end having a shoulder projecting towards an inside of said chassis and adapted to be supported on a shoulder of the other said wear plate.

7. A chassis as defined by claim 1, further comprising:

a second wear plate statically positioned on a second of said lateral flanges;

said wear plates being made in one piece and comprising, at an upper end, a bridge between said wear plates.

8. A chassis as defined by claim 1, wherein:

said plurality of wheels comprises at least two longitudinally intermediate wheels;

said chassis comprises laterally extending affixing holes for affixing said wheels to said chassis, said affixing holes including two oblong affixing holes positioned for affixing said two intermediate wheels to said chassis;

said detachable wear plate including laterally extending affixing holes spaced apart a certain distance; and a second detachable wear plate includes laterally extending affixing holes spaced apart a second distance different from said certain distance.

9. A chassis as defined by claim 1, wherein:

each of said two lateral flanges has a thickness and is recessed in said thickness by a depth corresponding to a thickness of each respective wear plate.

10. A chassis as defined by claim 1, wherein:

said two lateral flanges are laterally spaced apart by a distance for accommodating a width of a single wheel, said chassis thereby being adapted for an in-line roller skate.

11. A chassis for an in-line roller skate, said chassis comprising:

two lateral flanges and an upper platform connecting said lateral flanges, each of said two lateral flanges having a longitudinally extending downwardly open cut-out;

a plurality of longitudinally spaced apart wheels secured for rotation with respect to said flanges; and a respective detachable wear plate fixed against movement on each of said two lateral flanges and at least partially covering a respective one of said cut-outs, each of said wear plates being positioned between two of said wheels.

12. A chassis as defined by claim 11, wherein:

each of said wear plates comprises a lower edge having a downwardly open groove.

13. A chassis as defined by claim 12, wherein:

said downwardly open groove of each of said wear plates has a semi-circular shape.

14. A chassis as defined by claim 12, wherein:

said downwardly open groove of each of said wear plates has a substantially triangular shape.

15. A chassis as defined by claim 12, further comprising:

a plurality of wear plates, each of said wear plates having a differently shaped downwardly open groove for enabling a user to selectively secure wear plates having certain shapes to said chassis.

16. A chassis for a roller skate, said chassis comprising:

two lateral flanges bearing a plurality of wheels and an upper platform connecting said two flanges, said chassis further having a central portion and a scalloping in said central portion;

a detachable wear plate on said central portion of said chassis, said wear plate being positioned on one of said lateral flanges and extending between two of said wheels from a lower edge of said one of said lateral flanges, each of said scalloping being equipped with a peripheral groove and each of said wear plates comprising an associated peripheral rib.

17. A chassis for a roller skate, said chassis comprising:

two lateral flanges bearing a plurality of wheels and an upper platform connecting said two flanges, said chassis further having a central portion and a scalloping in said central portion;

a first detachable wear plate on said central portion of said chassis, said first wear plate being positioned on a first of said lateral flanges and extending between two of said wheels from a lower edge of said first of said lateral flanges;

a second detachable wear plate on said central portion of said chassis, said second wear plate being positioned on a second of said lateral flanges and extending between said two of said wheels from said lower edge of said second of said lateral flanges;

each of said wear plates comprises an upper end having a shoulder projecting towards an inside of said chassis and adapted to be supported on a shoulder of the other said wear plate.

* * * * *